US006088999A

United States Patent [19]

Olaechea

[11] Patent Number: 6,088,999

[45] Date of Patent: Jul. 18, 2000

[54] METHOD OF CLOSING TUBULAR BAGS FOR FRUIT AND VEGETABLE PRODUCTS

[76] Inventor: Rosalina Paniagua Olaechea, Plaza del Reino, 4, 8º, 15ª, 46600 Alzira (Valencia), Spain

[21] Appl. No.: 08/901,204

[22] Filed: Jul. 28, 1997

[30] Foreign Application Priority Data

Jul. 31, 1996 [EP] European Pat. Off. ..... 96500110

[51] Int. Cl.[7] ..... B65B 51/00

[52] U.S. Cl. ..... 53/417; 53/413; 53/478; 53/483; 156/309.6; 156/213; 156/475

[58] Field of Search ..... 53/459, 417, 413, 53/567, 139.1, 138.3, 138.4, 478, 483, 419; 156/309.6, 308.2, 213, 475

[56] References Cited

U.S. PATENT DOCUMENTS

| | | | |
|---|---|---|---|
| 2,908,123 | 10/1959 | Müller | 53/567 |
| 3,041,801 | 7/1962 | Harrison | 53/417 |
| 3,113,408 | 12/1963 | Kirkpatrick et al. | 53/417 |
| 3,322,325 | 5/1967 | Bush | 53/417 |
| 3,455,010 | 7/1969 | Busler | 53/138.4 |
| 3,540,184 | 11/1970 | Ashton | 53/139.1 |
| 3,732,662 | 5/1973 | Paxton | 53/417 |
| 4,223,508 | 9/1980 | Wells | 53/138.4 |
| 4,247,005 | 1/1981 | Buxton | 53/413 |
| 4,821,488 | 4/1989 | Donald | 53/417 |
| 4,993,210 | 2/1991 | Kollross | 53/469 |

FOREIGN PATENT DOCUMENTS

| | | | |
|---|---|---|---|
| 0003256 A1 | 8/1979 | European Pat. Off. | 53/417 |
| 44 21 366 | 12/1995 | Germany . | |

*Primary Examiner*—Jessica J. Harrison
*Assistant Examiner*—John Paradiso
*Attorney, Agent, or Firm*—Pillsbury Madison & Sutro LLP

[57] ABSTRACT

Method of closing tubular bags for fruit and vegetable products.

The method comprises:

1) closing the bag which has been filled, forming a region with a structure similar to a cord by twisting or other means;
2) superimposing a laminar element which can be welded to the bag on the closure region so that the said laminar element is partially wound on the closure region of the bag surrounding it completely, the said laminar element being partially superimposed on itself at the end of the winding;
3) intimately welding the superimposed laminar element to the closure region of the mesh bag on which it has been superimposed and onto itself in the overlapping region;
4) once welded, cutting the welding region transversely, defining two closure regions at the upper end of one bag and at the lower end of the next bag.

11 Claims, 17 Drawing Sheets

METHOD OF CLOSING TUBULAR BAGS FOR FRUIT AND VEGETABLE PRODUCTS

DESCRIPTION

The present invention relates to a method of closing tubular bags for fruit and vegetable products which has considerable features of novelty and inventiveness over the method known at present for carrying out this operation.

The present invention will be applicable to the closure of tubular bags such as those usually used for the packaging of fruit and vegetable products such as citrus fruits, various fruits, vegetables, etc.

At present, mesh bags are individualized during the packing stage and their ends are pinched and fixed particularly by means of metal staples. The said staples are placed laterally on the cord formed by the closed mesh bag and the ends of the staple are compressed inwardly, fastening the cord formed by the closed mesh bag. In this system which is currently very widespread, the closure of the mesh bag is achieved fairly cheaply but with a relatively low degree of perfection of the closure since the closure effect by compression of the end flaps of the mesh does not achieve satisfactory results in every case, particularly because the centring of the staple relative to the mesh cord is fairly imperfect and in many cases results in out-of-centre stapling which leaves a portion of the mesh of the bags outside the staple or results in incorrect tightening of the staple.

The present invention is intended to solve the problems mentioned above disclosing new means for effectively and cheaply closing the ends of mesh bags.

The present invention is based fundamentally upon the closure of the mesh bags in the region of the cord formed after the packing of an individual bag, by the superimposition of an element of plastics material which completely surrounds the mesh cord formed in the closure operation, in a manner such that the width of the plastics element is greater than the periphery of the closed mesh bag, that is, the laminar covering element completely surrounds the end closure region of the bag, particularly in the form of a cord or the like, and overlaps itself in a certain section, thus ensuring that the whole of the closure region of the mesh bag is included inside the said laminar element. This makes it impossible for certain parts of the closure of the mesh bag to remain outside the closure means. Simultaneously with the application of the laminar element in the manner indicated above, the said laminar element is welded to the mesh bag, resulting in complete and intimate incorporation of the said laminar element on the closed end of the mesh bag, the said welding being brought about by any suitable technical means, although ultrasound welding has been found particularly favourable.

The present invention also has particularly advantageous characteristics from the point of view of the possibility of recycling the bags used for fruit and vegetable products since, as a result of the ability to select the same material for the laminar element supplied as for the bag, once the bag is closed, only a single material is used for the bag itself and for the closure whereas, at present, the use of metal staples prevents the said homogeneity of material and hinders recycling which is further complicated by the use of labels, bands, etc. For this reason, the method of the present invention will include essentially the following steps:

1) closing the bag which has been filled, forming a region with a structure similar to a cord or similar element by flattening, twisting, bunching or other means;
2) superimposing a laminar element which can be welded to the bag on the closure region produced in the preceding step so that the said laminar element is partially wound on the closure region of the bag surrounding it completely, the said laminar element being partially superimposed on itself at the end of the winding;
3) intimately welding the superimposed laminar element to the closure region of the mesh bag on which it has been superimposed and onto itself in the overlapping region;
4) cutting the welding region transversely, defining two closure regions belonging to the upper end of the bag already filled and to the lower end of the next bag to be filled, respectively.

As indicated above, the material of the laminar element will preferably be the same as the material of the mesh constituting the bags.

For a better understanding, some drawings corresponding to preferred embodiments of the method of the present invention are appended, by way of non-limiting example.

Figure 17:
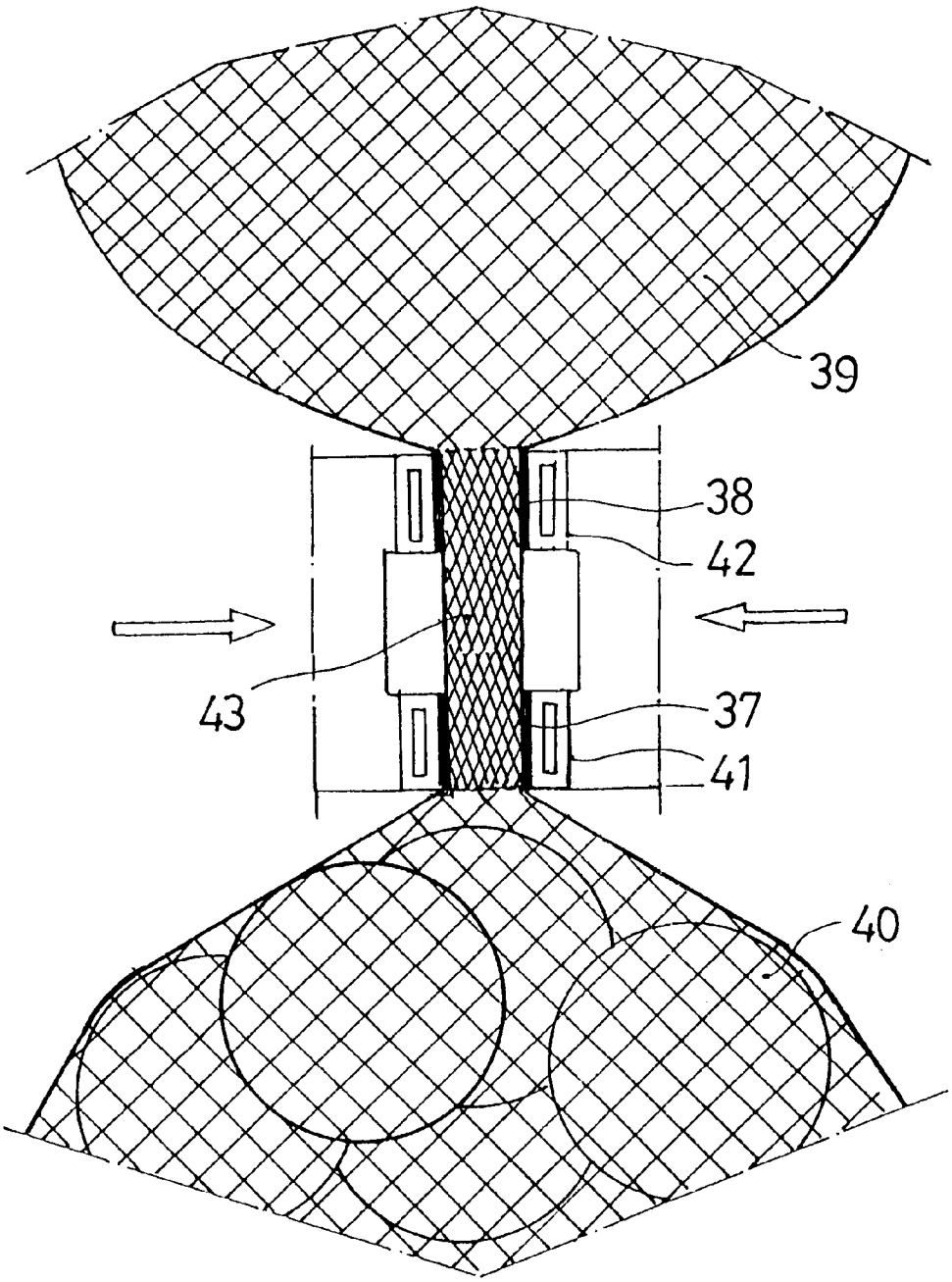
FIG. 17 shows a variant of the present invention.
Figure 18:
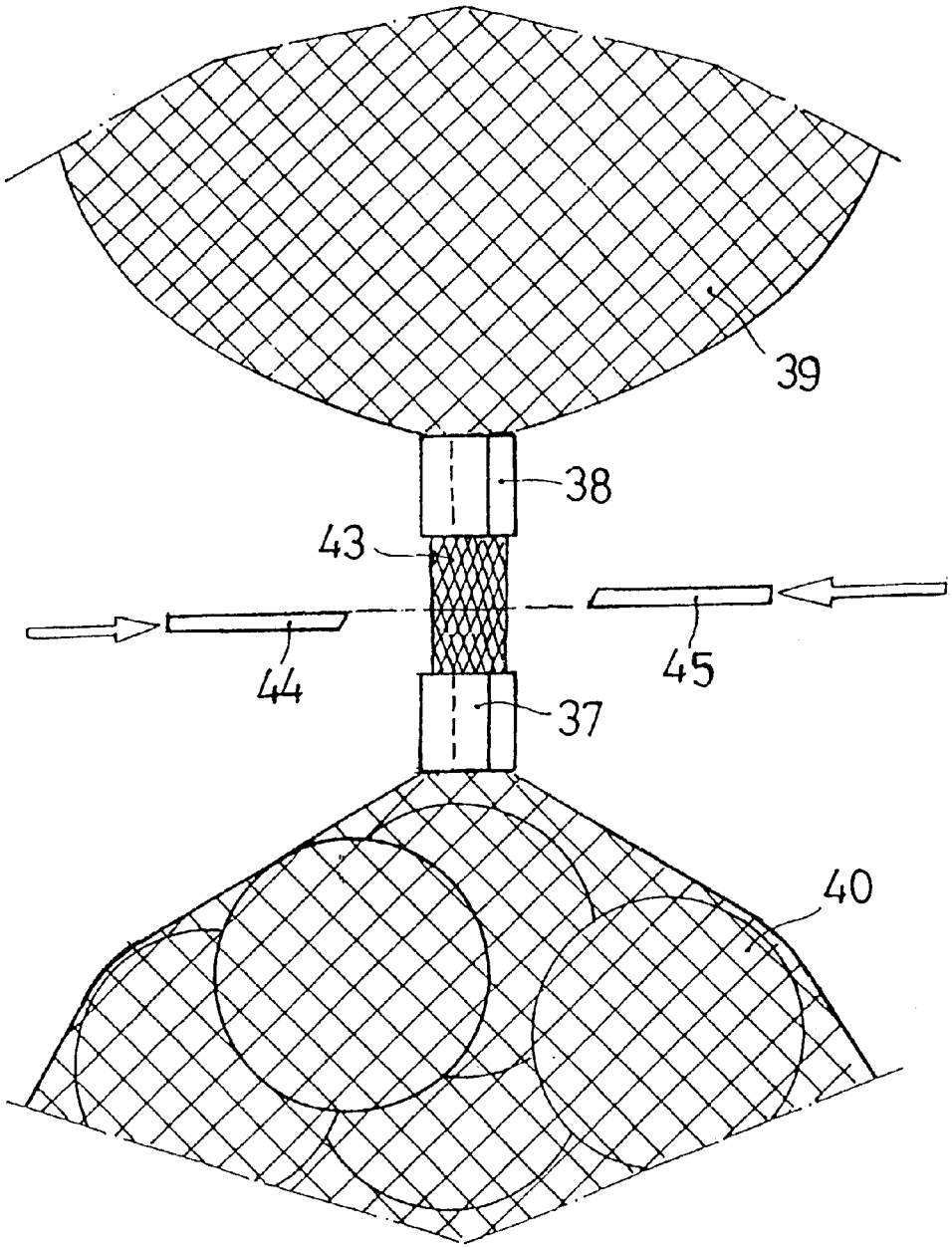

FIG. 18 corresponding to a section taken after the welding step shown in FIG. 17.

Figure 19:
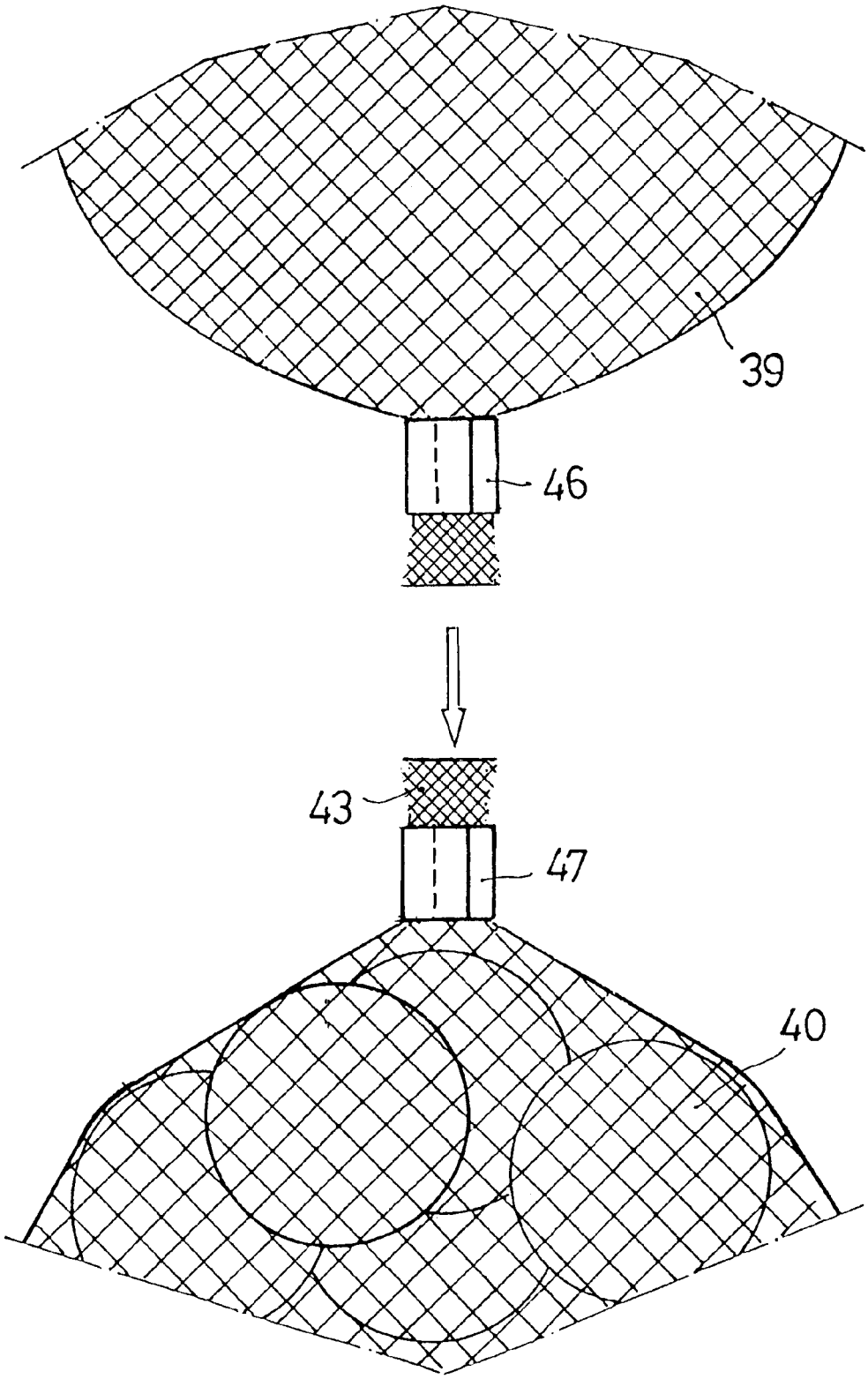

FIG. 19 is a view similar to FIG. 18 showing the fastening which has been cut after welding.

Figure 20:
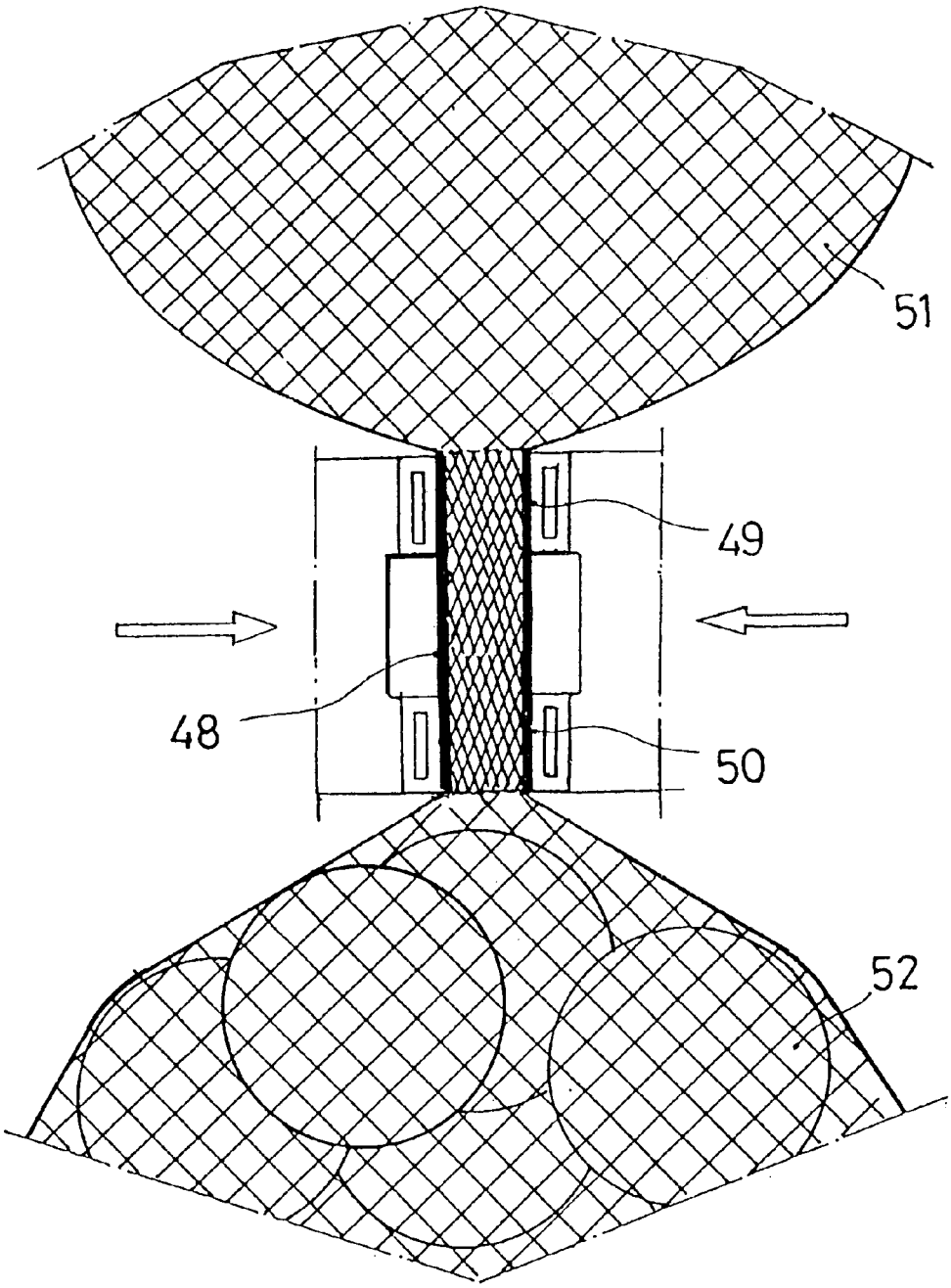

FIG. 20 shows a variant in which the added element is welded only at the ends.

Figure 21:
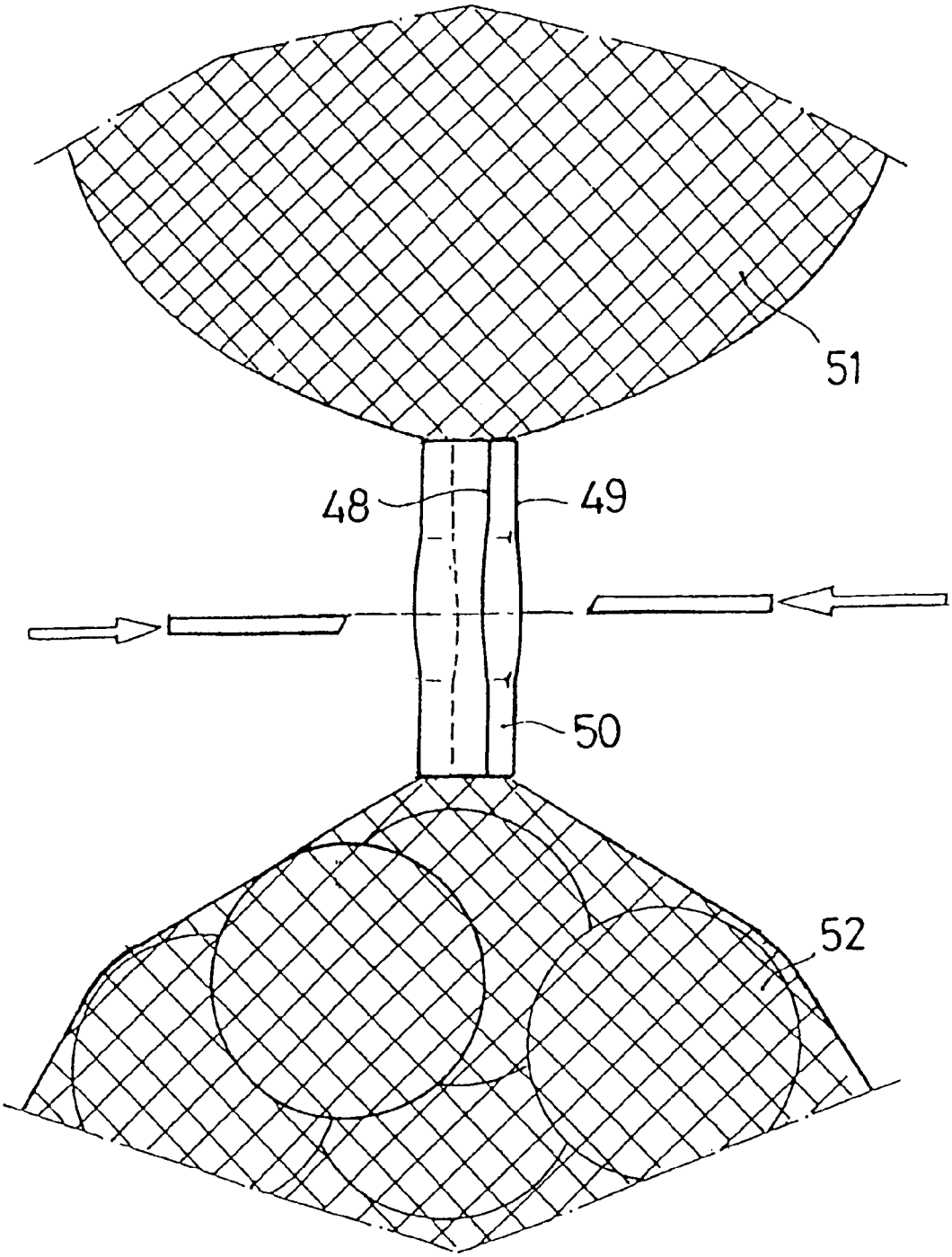
Figure 22:
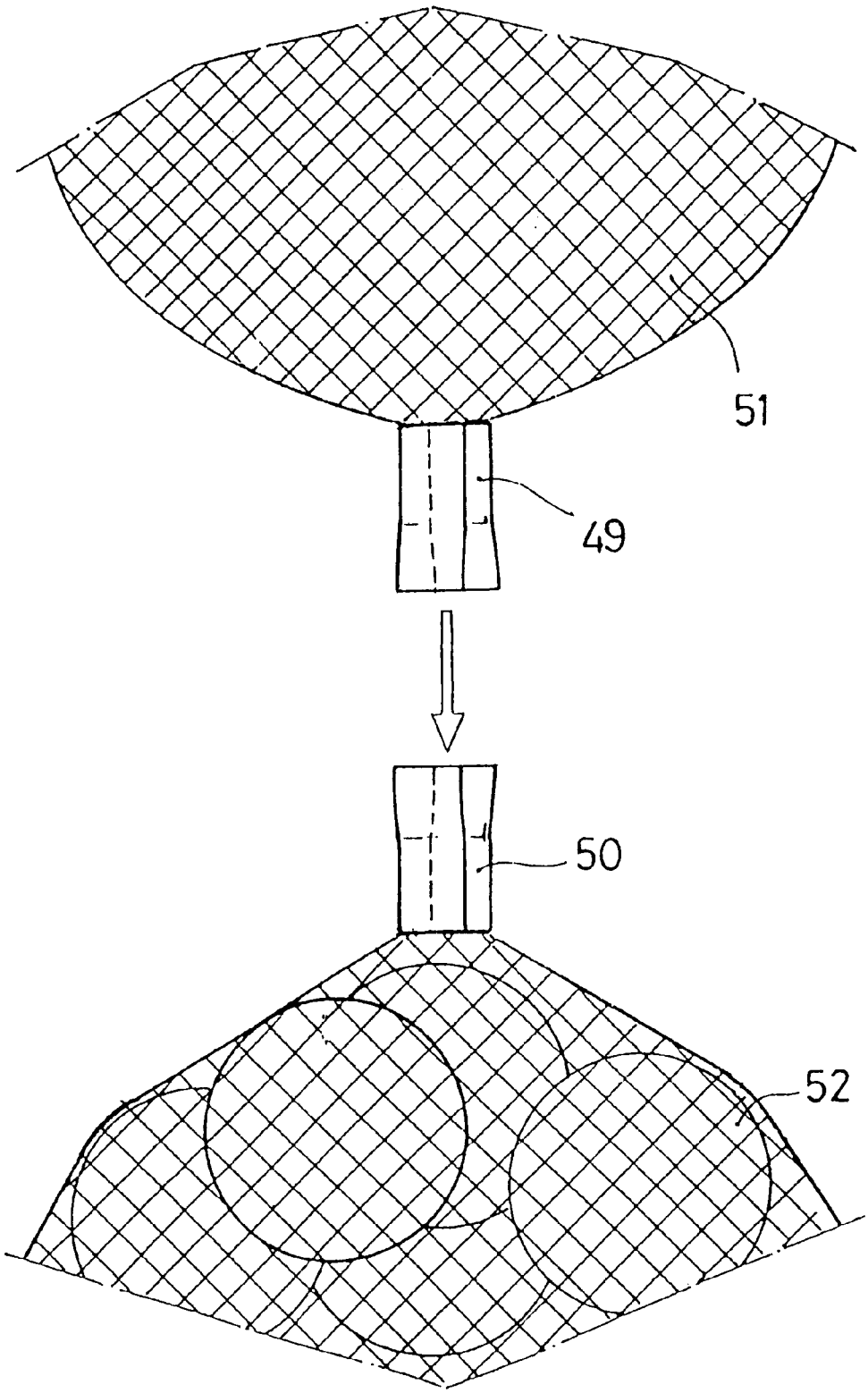

FIGS. 21 and 22 show the step of the cutting of the element shown in FIG. 20.

Figure 23:
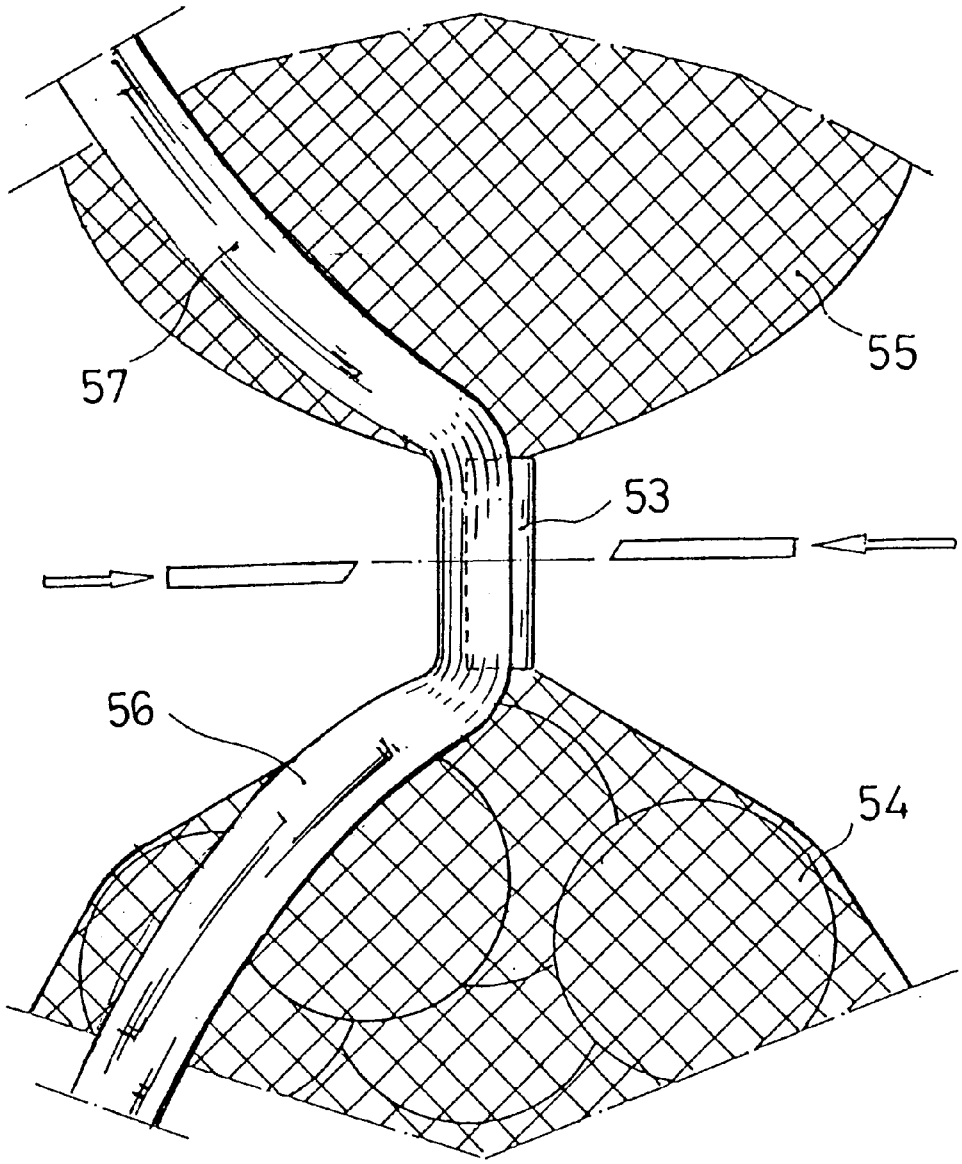

FIG. 23 shows a version in which the enveloping welding element is the tape forming part of longitudinal handles of the bags.

Figure 24:
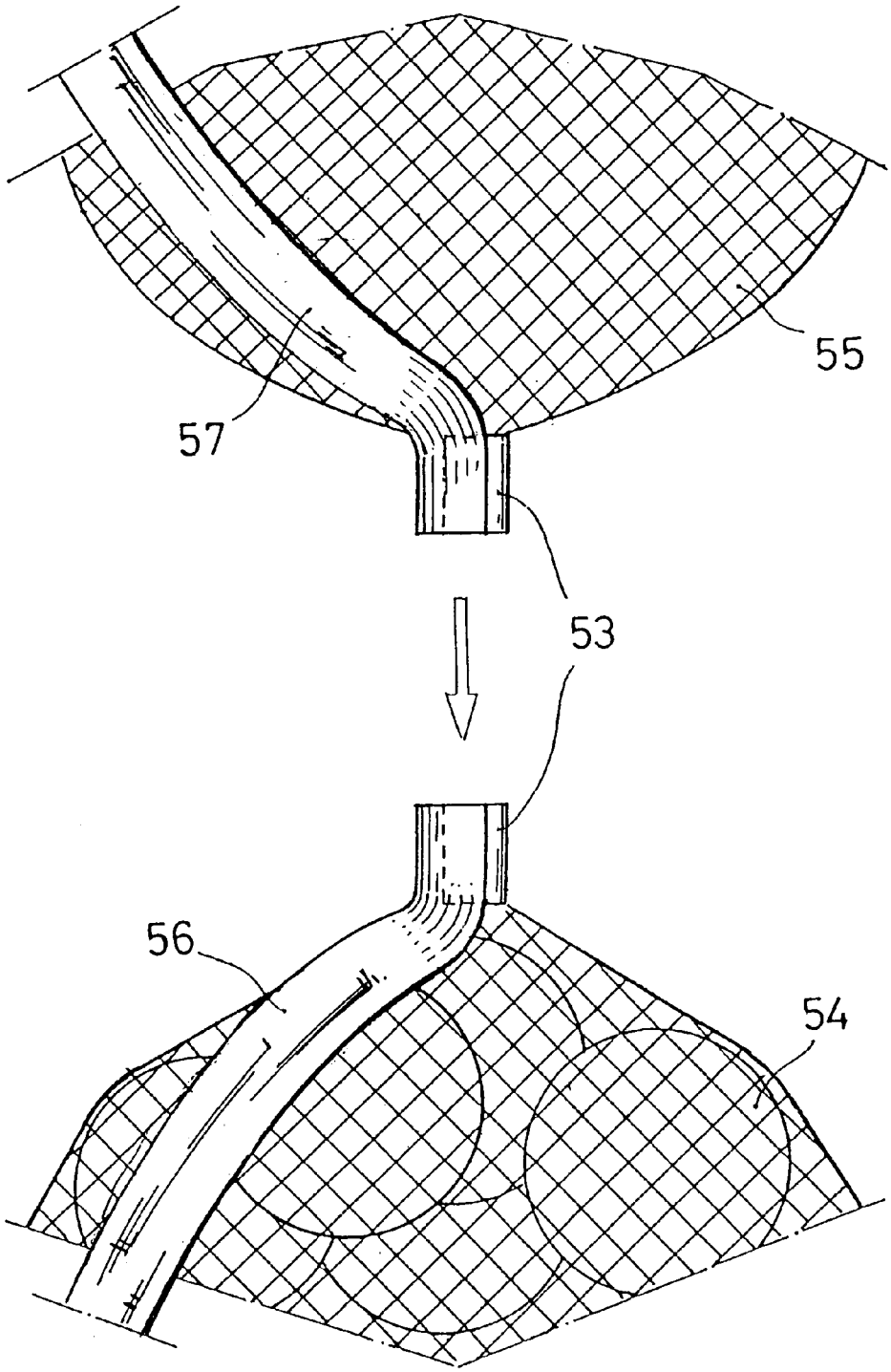

FIG. 24 shows the version of FIG. 23 once cut.

Figure 25:
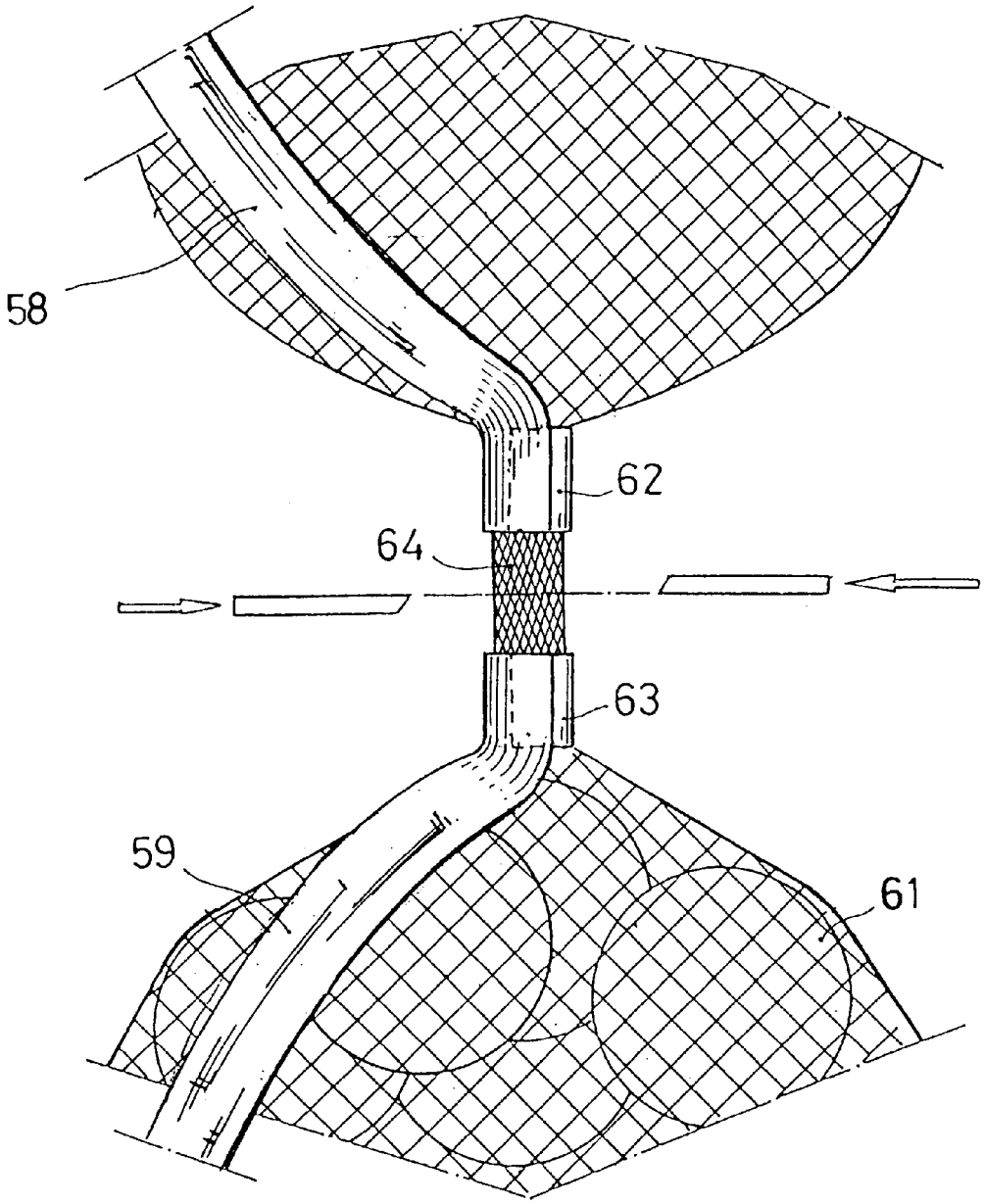

FIG. 25 shows a version of laminar elements combined with discontinuous longitudinal handles.

Figure 26:
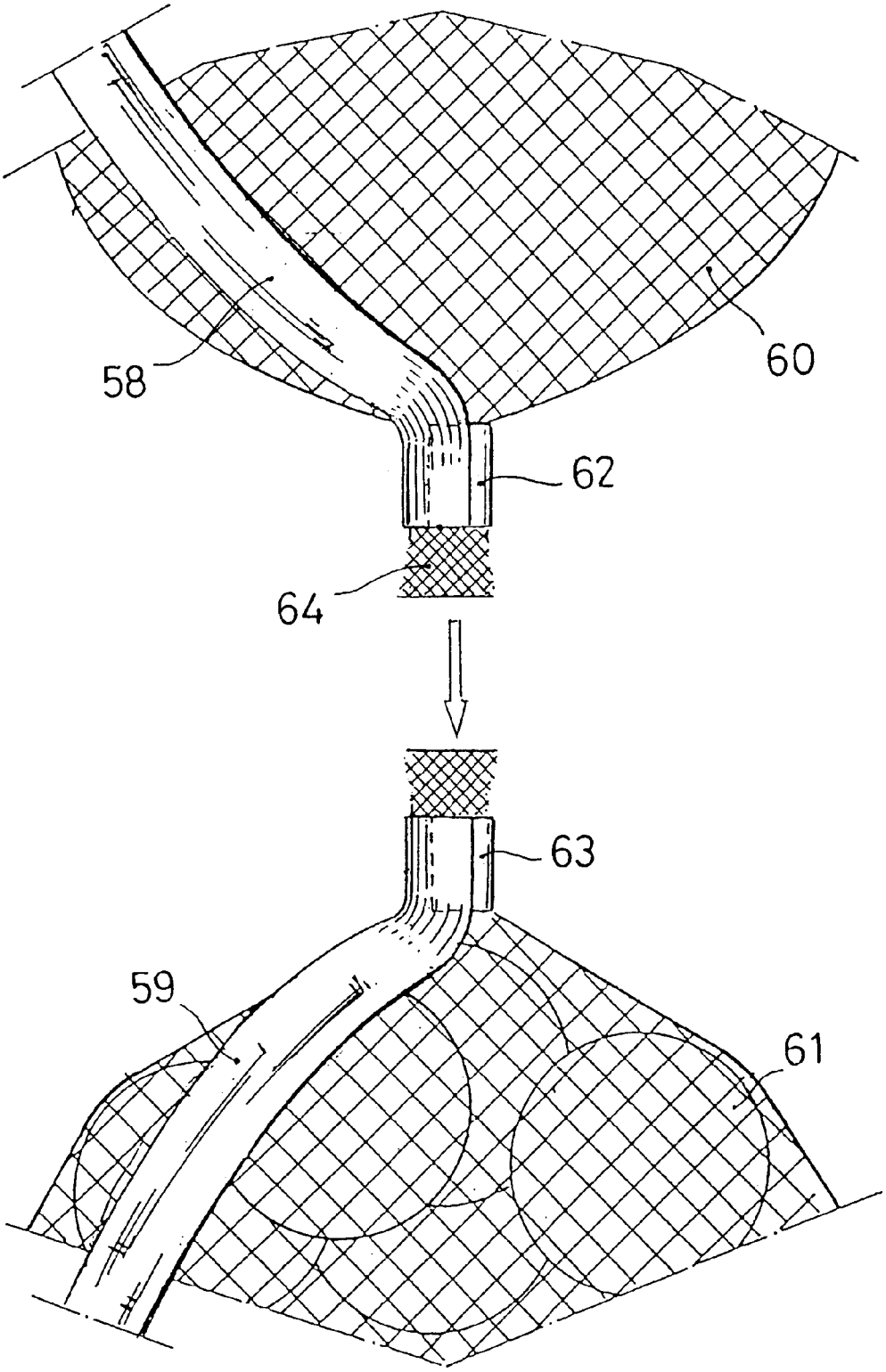

FIG. 26 shows the version of FIG. 25 after cutting.

Figure 1:
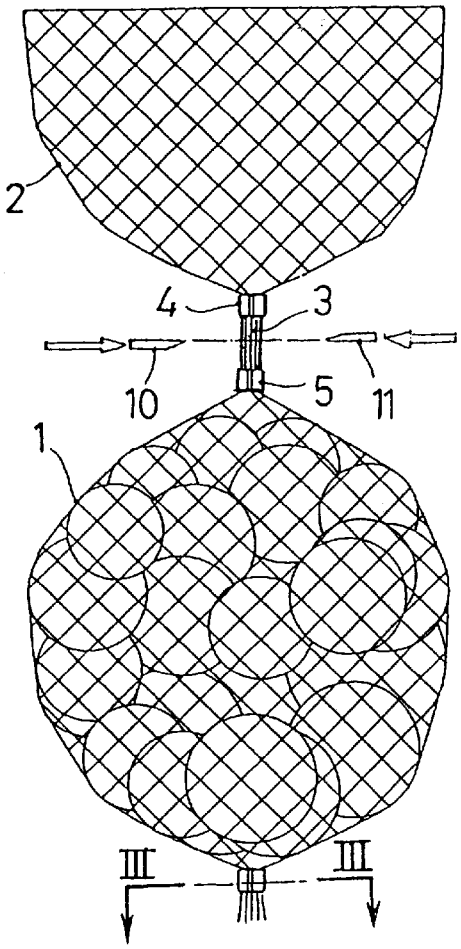
FIGS. 1, 2 and 3 are views showing the use of staples according to the prior art.
Figure 2:
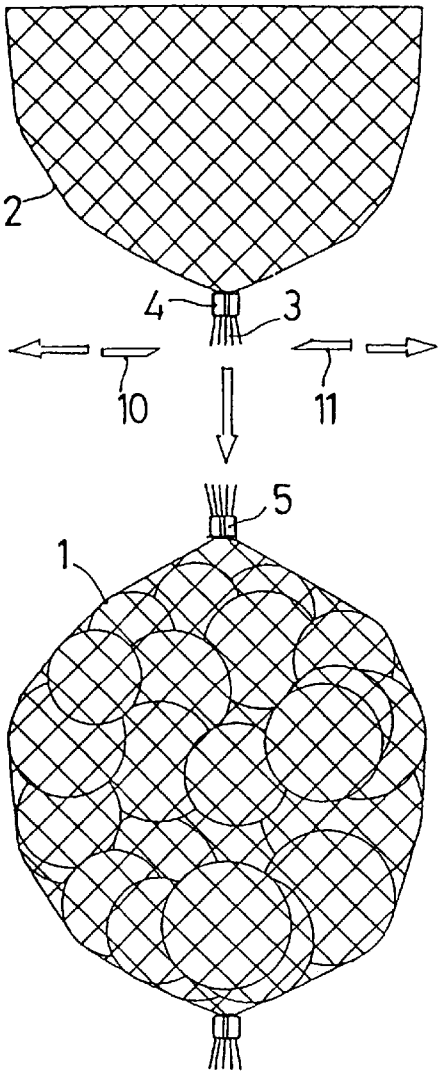
Figure 3:
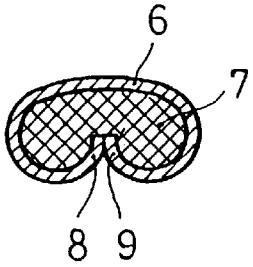

At present, mesh bags such as the freshly filled bag 1 of FIG. 1 still joined to the as yet unfilled bag 2 by means of a narrow region 3 of the material of the mesh which forms the bags are usually closed by the attachment of respective staples 4 and 5 adjacent both bags by mechanical means. The said staples conform to the structure shown in FIG. 3 in which can be seen a staple, indicated 6, which encircles the closed mesh 7 and the ends 8 and 9 of which are preferably partially turned round towards the interior of the closed mesh by mechanical compression so that the staple is retained, effecting the fastening. The intermediate region 3 is subsequently cut by means of blades, schematically indicated 10 and 11 in FIG. 1, separating the bags, as can be seen in FIG. 2.

Figure 4:
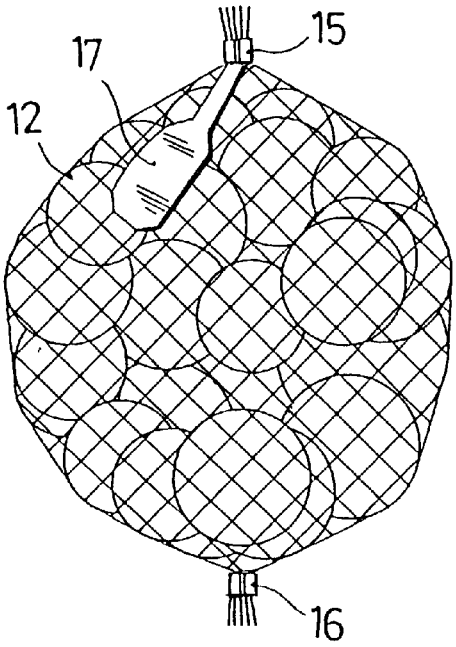
FIGS. 4, 5 and 6 are respective perspective views of distinct embodiments including identification systems such as bands or labels, according to the prior art.
Figure 5:
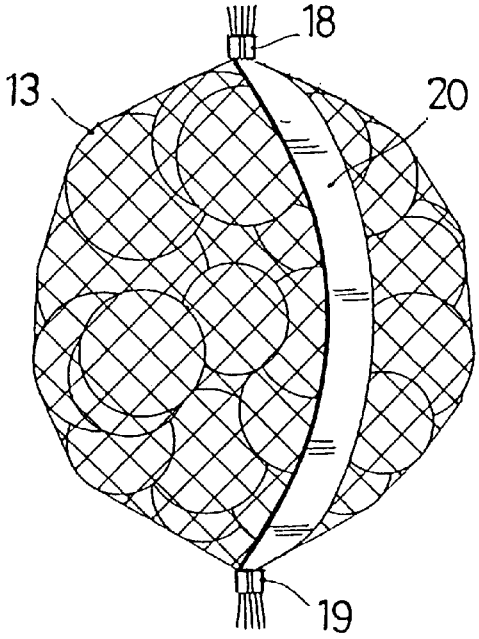
Figure 6:
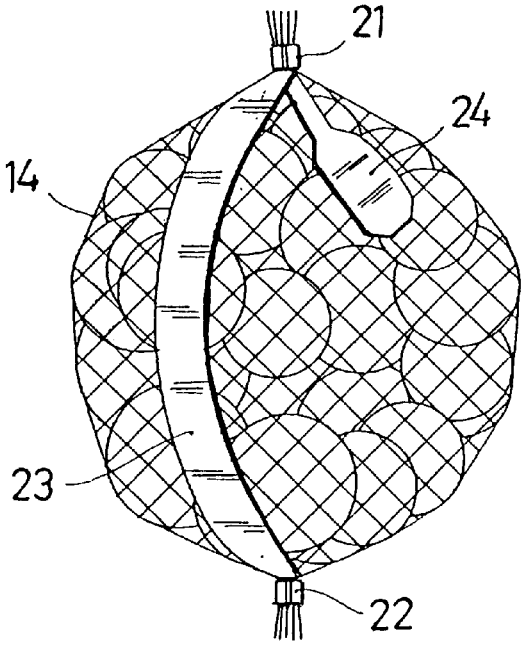

FIGS. 4, 5 and 6 show respective versions of mesh bags indicated 12, 13 and 14 which conform to the previously known type illustrated in the preceding drawings. In the case of the bag of FIG. 4, the closure staples 15 and 16 are complemented by a pendant label 17 with a connecting arm. In the case of the mesh in FIG. 5, the staples 18 and 19 are complemented by a strip 20 connecting the top to the bottom and, in the case of the mesh of FIG. 6, the corresponding staples, indicated 21 and 22, fix a band 23 extending from top to bottom and a pendant label 24, in addition to the ends of the bag.

Figure 7:
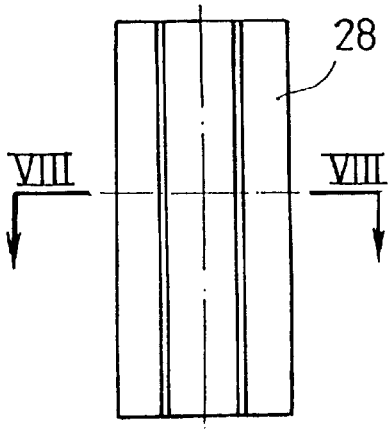
FIGS. 7 and 8 are a front elevational view and a sectional view, respectively, of a laminar element for closing the bags according to the present invention.
Figure 8:
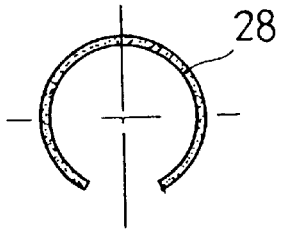
Figure 9:
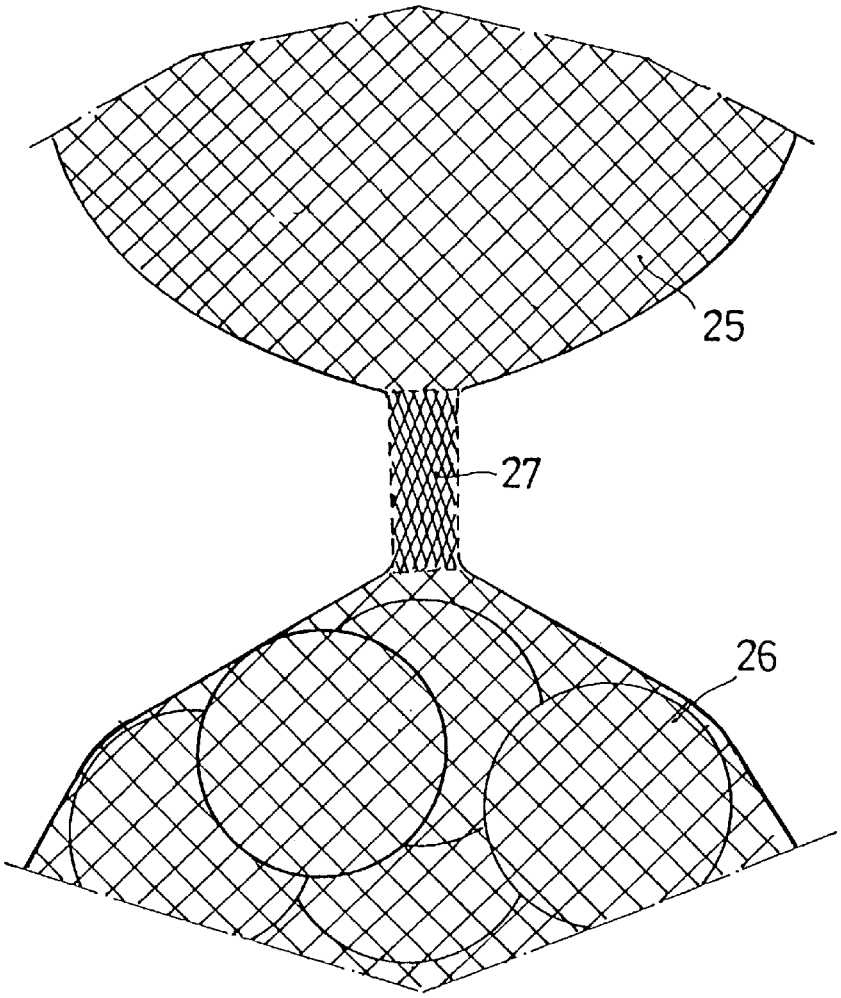
FIG. 9 shows the closure region of the bags according to the present invention.
Figure 10:
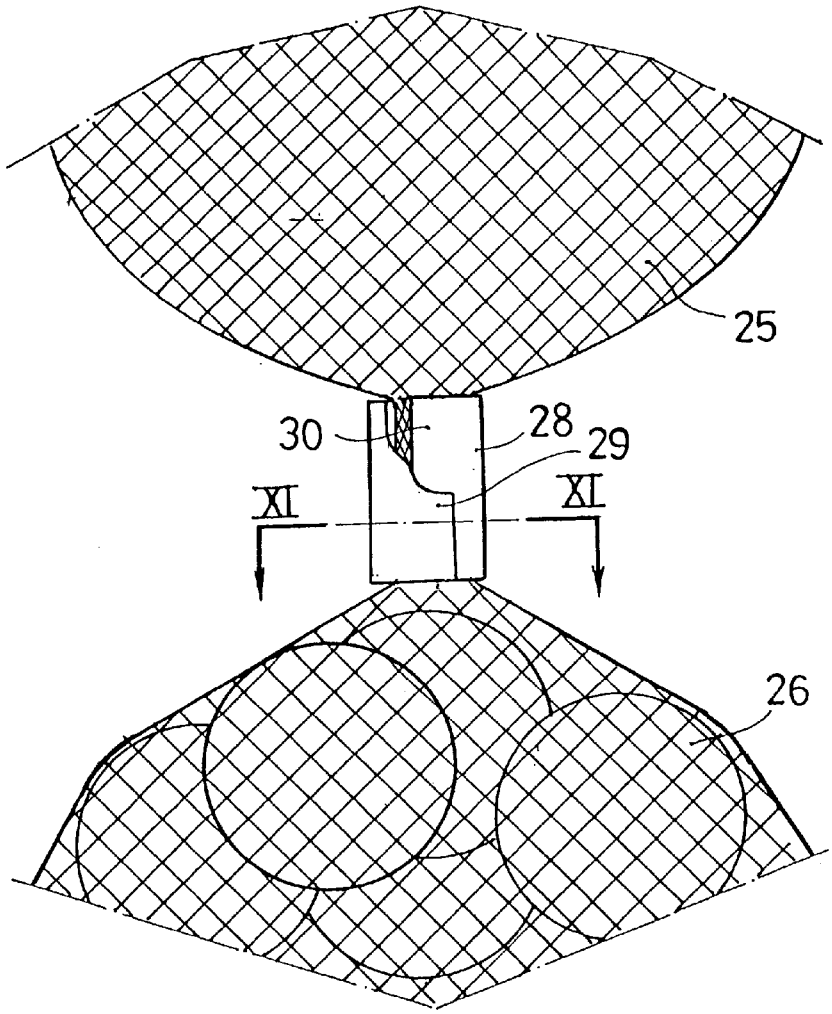
FIG. 10 shows the placing of the superimposition element in the closure region of bags according to the present invention.
Figure 11:
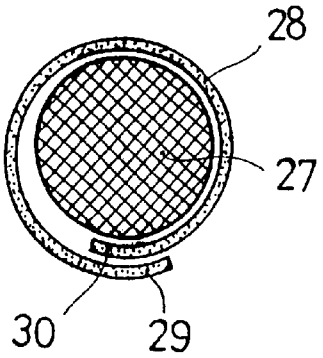
FIG. 11 shows a detail sectioned in the section plane shown in FIG. 10.

The method of the present invention consists essentially in the closure of the mesh bags, for example, those indicated 25 and 26 in FIG. 9, forming a connecting region 27 in which the bag adopts the shape of a cord or the like connecting the bag 26 already filled with items of fruit or vegetables and the bag 25 which will be filled subsequently. A laminar element 28, shown in FIGS. 7 and 8, is then placed over the region 27, preferably adopting a bent structure which, when unrolled, is substantially rectangular and the width of which is greater than the length of the periphery of the cord or connecting region 27, as a result of which, after the laminar element 28 has been placed in a substantially rolled-up shape, as shown in FIG. 10, one edge 29 thereof overlaps the other edge 30 of the element itself thus forming a complete envelope as shown in FIG. 11.

Figure 12:
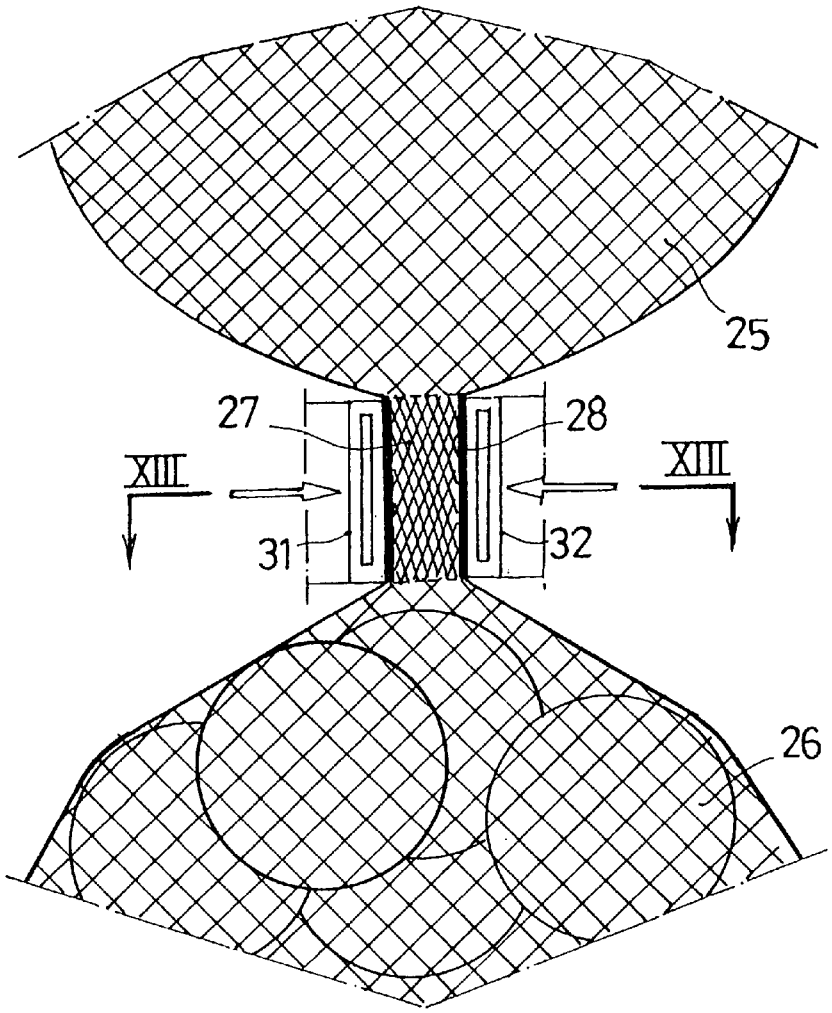
FIG. 12 shows the step of the welding of the fastening according to the present invention.
Figure 13:
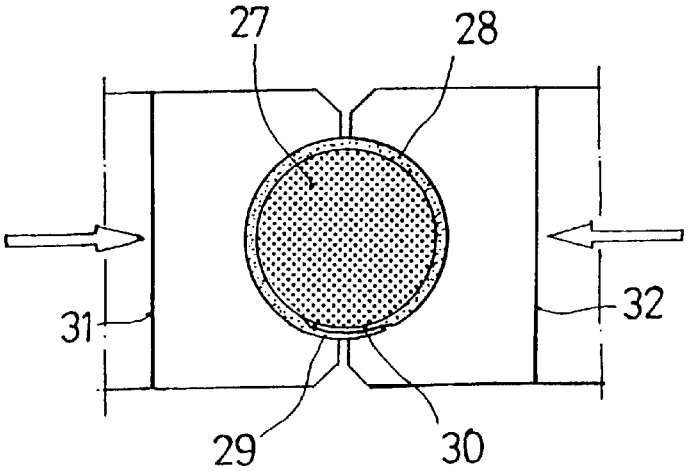
FIG. 13 shows a detail sectioned in the plane indicated in FIG. 12.

A welding step is then carried out as shown in FIGS. 12 and 13, in which the welding jaws 31 and 32 are shown schematically completely encircling the enveloping laminar element 28, completely and intimately welding the element 28 to the cord or the like of the mesh bag 27. It will be particularly favourable for welding purposes and also for the purposes of the recyclability of the closed bag for the element 28 to be made the same material as the mesh bag.

Figure 14:
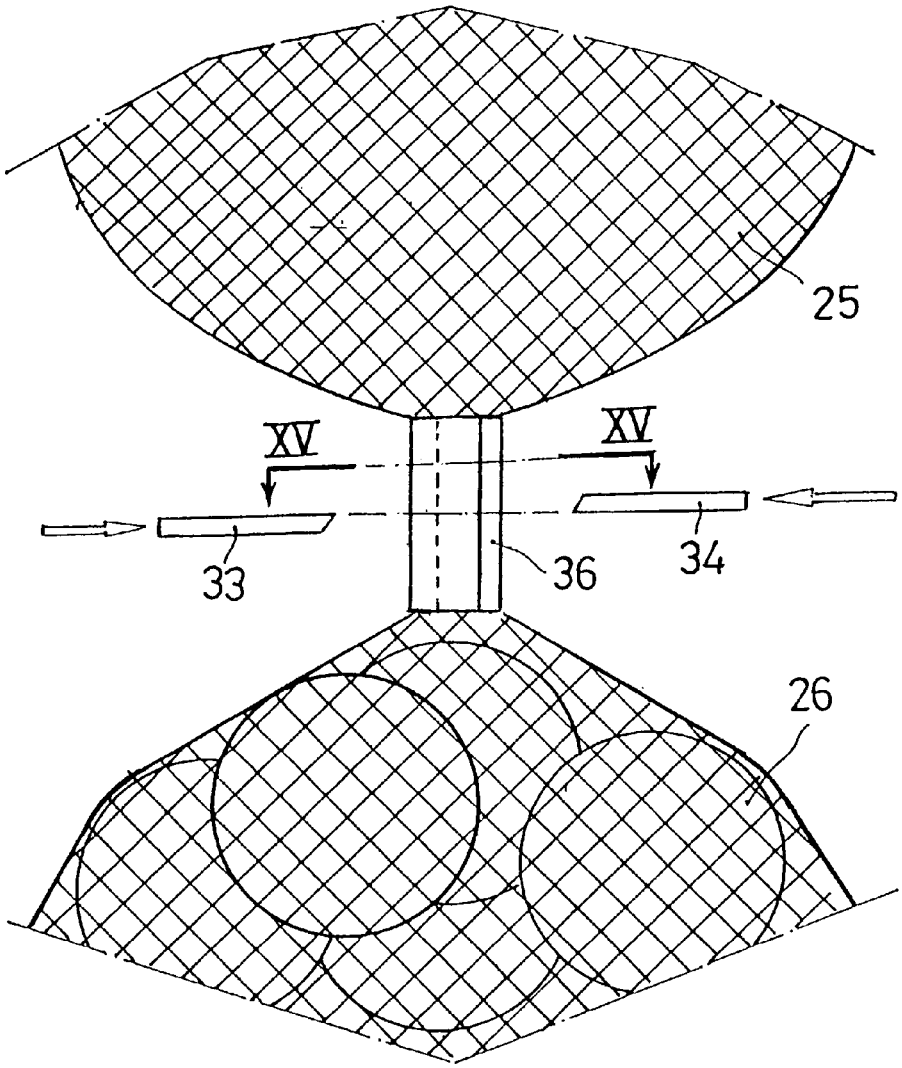
FIG. 14 shows schematically the cutting step in an embodiment of the present invention.
Figure 15:
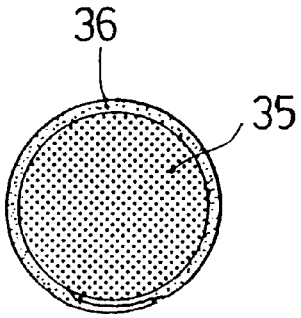
FIG. 15 is a view sectioned in the section plane indicated.

The next step will involve cutting by means of conventional blades such as 33 and 34 shown in FIG. 14 which will produce ends of the mesh bags as shown in FIG. 15 with a well restrained and welded core 25 of the mesh constituting the bags and the outer envelope which will adopt the structure of an enveloping tubular element 36 joined intimately to the inner core 35 by welding.

Figure 16:
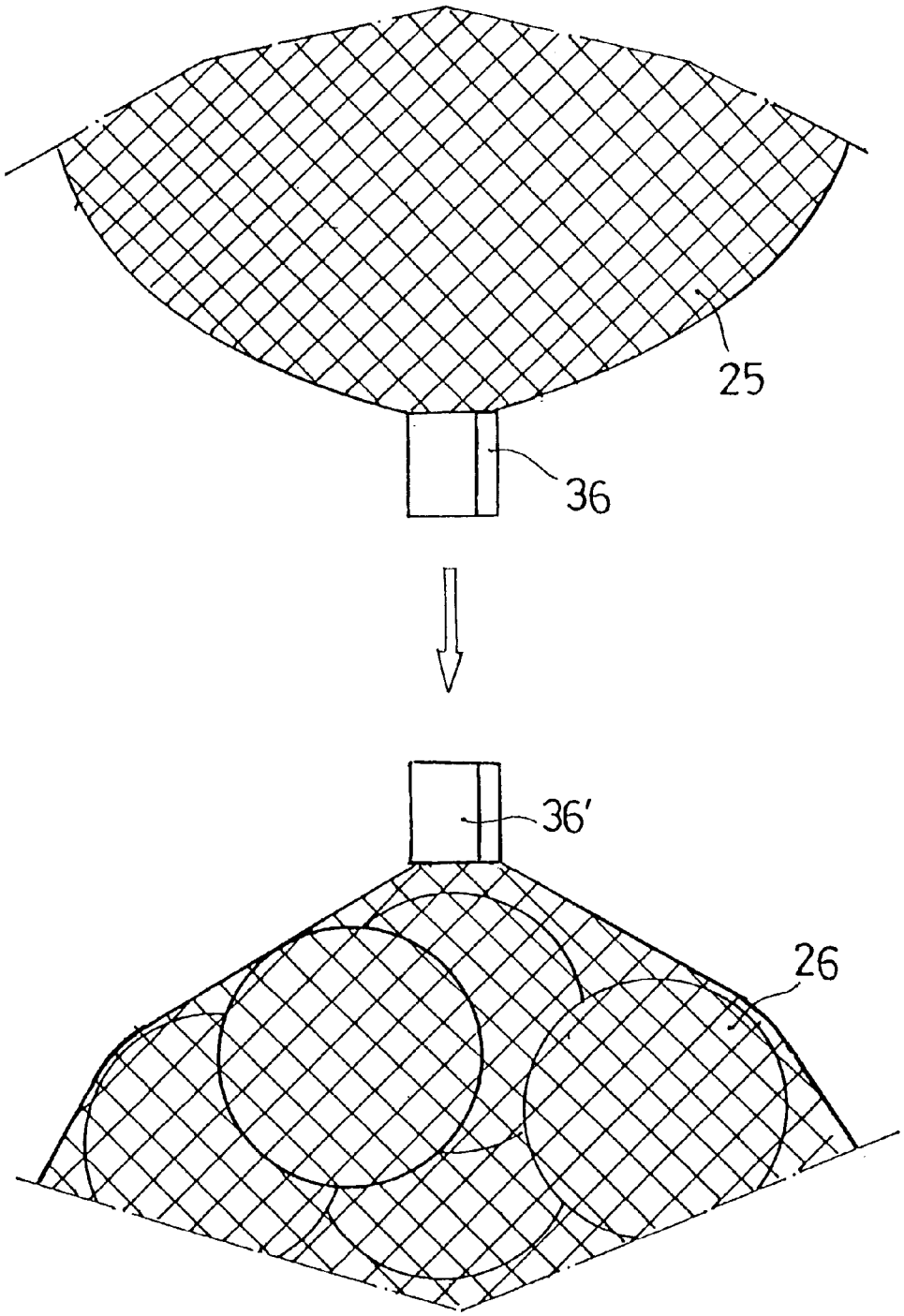
FIG. 16 is a view similar to FIG. 14 with the welding region cut.

After cutting, the two bags will be completely separated as shown in FIG. 16 in which the bags, indicated 25 and 26, will be closed at their lower and upper ends, respectively, by means of welded knobs 36 and 36' made of the same material as the bags and achieving perfect closure of the bags themselves.

According to a variant shown in FIG. 17, instead of a single laminar element enveloping the connecting region, two shorter, individual elements, indicated 37 and 38, may be placed in regions bordering the ends of both bags, indicated 39 and 40. In this case, the welding head will have differentiated active elements 41 and 42 for the closure of the bags, which will produce an intermediate region 43 without welding, which will subsequently be cut as shown by means of the blades 44 and 45, FIG. 18, finally producing the individual welded knobs 46 and 47 which are shown in FIG. 19.

FIG. 20 shows a version in which the tubular element 48 is welded only at its upper and lower ends 49 and 50, forming two differentiated welding regions for the closure of the adjoining bags 51 and 52.

Cutting as shown in FIGS. 21 and 22 will produce the welded ends of both bags.

FIGS. 23 and 24 show a version in which the enveloping laminar element 53 forms part of a strip which extends longitudinally along the bags 54 and 55 themselves forming longitudinal handles such as 56 and 57. The said single longitudinal strip is welded in the central portion 53 in the manner explained above, forming welded closures of the two adjoining bags.

This combination of the handles with the enveloping regions for welding is also shown in another version in FIGS. 25 and 26 in which it can be seen that the longitudinal handles 58 and 59 of the bags 60 and 61 form enveloping bands 62 and 63 for the ends of the closure region 64, enabling the welding to be carried out in the said regions and thus producing a combined structure with the longitudinal handles.

I claim:

1. A method of closing tubular bags for fruit and vegetable products, applicable to the closure of bags formed from a continuous mesh element, which receives the products to be wrapped, with subsequent closure of the region intermediate each pair of bags, comprising the following steps:

closing the bag which has been filled by forming a closure region with a structure similar to a cord by flattening, bunching, twisting or other means;

disposing a weldable laminar element onto the closure region produced in the preceding step so that the laminar element is wound around the closure region surrounding the closure region completely and ends of the laminar element overlap;

welding the laminar element to the closure region of the mesh bag and onto itself in the overlapping region; and cutting the laminar element transversely, defining two closure regions belonging to the upper end of the bag already filled and to the lower end of the next bag to be filled, respectively.

2. A method of closing tubular bags for fruit and vegetable products according to claim 1, wherein the laminar element envelops the closure region along an entire length of the closure region.

3. A method of closing tubular bags for fruit and vegetable products according to claim 1, wherein the laminar element is made of a material which can be welded to the mesh bag.

4. A method of closing tubular bags for fruit and vegetable products according to claim 3, wherein the laminar element is made of the same material as the mesh bag.

5. A method of closing tubular bags for fruit and vegetable products according to any one of the preceding claims, wherein a width of the laminar element is greater than the peripheral length of the closure region of the mesh bags.

6. A method of closing tubular bags for fruit and vegetable products according to claim 1, characterized by the application of an individual laminar element to the corresponding end of each of the successive bags before welding.

7. A method of closing tubular bags for fruit and vegetable products according to claim 1, characterized by the welding of the laminar element disposed on the closure region of the bags causing its integration with the material of the bags and with itself in the overlapping regions.

8. A method of closing tubular bags for fruit and vegetable products according to claim 1, characterized by the cutting of the welded region at a point intermediate two successive bags, producing welded end knobs delimiting each bag.

9. A method of closing tubular bags for fruit and vegetable products according to claim 1, wherein a single laminar element for connection by welding in the region intermediate two successive bags is welded only in the regions adjacent each of the successive bags, respectively, enabling the cutting through the intermediate region which is not welded.

10. A method of closing tubular bags for fruit and vegetable products according to claim 1, wherein the laminar element disposed on the closure region intermediate two successive bags which is intended to receive the welding forms part of a longitudinal strip, parallel to the strip of bags and forming longitudinal handles thereon.

11. A method of closing tubular bags for fruit and vegetable products according to any one of claims 6 to 8, wherein the individual laminar elements for the welding of the connection of each of the successive bags form part of segments of longitudinal strips which extend along each bag forming respective longitudinal handles thereon.

* * * * *